United States Patent [19]

Laughon et al.

[11] Patent Number: 4,928,913

[45] Date of Patent: May 29, 1990

[54] WALL MOUNTING SYSTEM

[75] Inventors: Thomas C. Laughon; Roy V. Nicholson; Michael E. Barrett, all of Hickory; Robert C. Beckmann, Vale, all of N.C.

[73] Assignee: McCalla/Lackey Products Corporation, Hickory, N.C.

[21] Appl. No.: 321,378

[22] Filed: Mar. 10, 1989

[51] Int. Cl.[5] ..... A47B 67/02

[52] U.S. Cl. ..... 248/224.1; 248/243; 248/214; 312/245; 211/90; 211/94

[58] Field of Search ..... 248/544, 220.2, 223.4, 248/235, 300, 220.3, 224.1, 224.2, 224.4, 241, 243, 247, 248, 214; 108/108, 102, 143, 137; 211/162, 94, 90, 87; 312/245

[56] References Cited

U.S. PATENT DOCUMENTS

| | | | |
|---|---|---|---|
| 178,534 | 6/1876 | Latham | 248/224.2 |
| 1,880,179 | 9/1932 | Onions | 248/243 |
| 2,191,701 | 2/1940 | Wood | 248/243 |
| 2,521,134 | 9/1950 | Stanitz | 312/245 |
| 3,311,435 | 3/1967 | Heritage | 248/224.2 |
| 3,337,172 | 8/1967 | Jackson | 312/245 |
| 3,899,228 | 8/1975 | Schreiber | 312/245 |
| 3,950,049 | 4/1976 | Drass | 312/245 |
| 3,993,002 | 11/1976 | Stroh | 211/90 |
| 4,342,439 | 8/1982 | Bruner | 248/544 |
| 4,467,925 | 8/1984 | Ratzloff | 248/214 |
| 4,596,195 | 6/1986 | Wenger | 211/94 |
| 4,793,267 | 12/1988 | Birillo | 108/108 |

FOREIGN PATENT DOCUMENTS

| | | | |
|---|---|---|---|
| 2276019 | 1/1976 | France | 248/224.1 |
| 2490940 | 4/1982 | France | 312/245 |
| 1198887 | 7/1970 | United Kingdom | 248/243 |

*Primary Examiner*—Blair M. Johnson
*Assistant Examiner*—Robert A. Olson
*Attorney, Agent, or Firm*—Bailey & Hardaway

[57] ABSTRACT

A wall mounting system wherein a single horizontal rail is attached to a wall structure and suspended components are supported by an undercut forming a cleat on the top of the rail. The supported structures may be cabinets, vertical rails supporting shelving brackets mounted so as to eliminate the view of the mounting system from a frontal observation, a novel insert is provided to aid in suspending members from the horizontal rail.

10 Claims, 2 Drawing Sheets

WALL MOUNTING SYSTEM

BACKGROUND OF THE INVENTION

This invention relates generally to the art of wall mounted structures and, more particularly, to the art of providing such structures with a high degree of flexibility.

There has recently been an upsurge in marketing efforts of systems designed to aid the homeowner with organization of various areas within the household. Closets have been the subject of commercial systems which provide a variety of compartments, shelves and hanging systems so as to greatly enhance the utilization of space therein. These systems have also been utilized to enhance workshop areas and pantries so as to eliminate the need for a large degree of permanent fixtures.

Retail display shelving has been the subject of professional systems which have not required professional onsite fabrication of display devices.

To date, however, there have been no systems which minimize wall damage upon installation while simultaneously providing a high degree of flexibility.

SUMMARY OF THE INVENTION

It is thus an object of this invention to provide a novel wall mounting system.

It is a further and more particular object of this invention to provide such a wall mounting system which minimizes wall damage due to the attachment of the wall mounting system to the wall.

It is a further and more particular object of this invention to provide a system which has flexibility in the type of suspended systems placed in the wall mounting system.

These as well as other objects are accomplished by a wall mounting system wherein a single horizontal rail is attached to a wall structure and suspended components are supported by an undercut forming a cleat on the top of the rail. The supported structures may be cabinets, vertical rails supporting shelving brackets mounted so as to eliminate from view the mounting system from a frontal observation. A novel insert is provided to aid in suspending members from the horizontal rail.

DETAILED DESCRIPTION

In accordance with this invention it has been found that a single wall mounted horizontal rail may be provided to support various and diverse structures from a vertical wall. It has been found that the horizontal rail is the only structure which needs to be actually attached to the wall in such a manner so as to penetrate the wall structure. Suspended structures are suspended from this rail without the need for additional wall penetration or attaching means. Various other advantages and features will become apparent from a reading of the following description given with reference to the various figures of drawings.

Figure 1A:
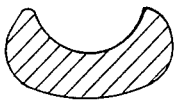
FIG. 1 of the drawings is a perspective view of a horizontal rail supporting a suspended member in accordance with this invention.
Figure 1:
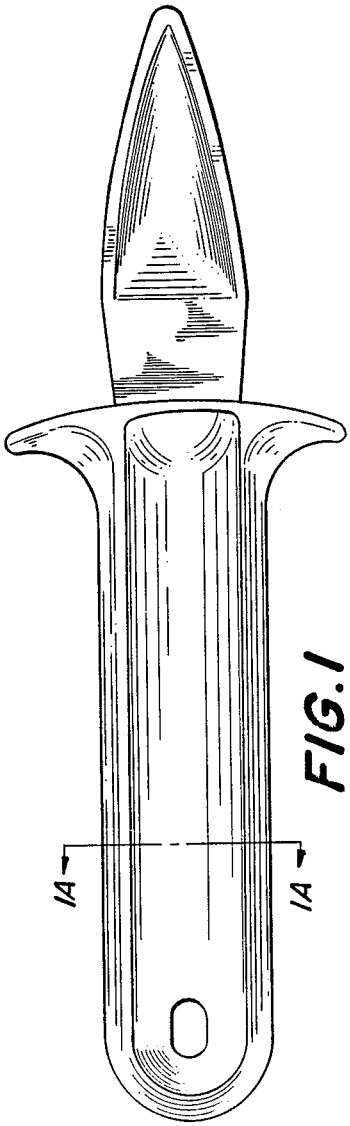

FIG. 1 of the drawings illustrates a horizontal rail 1 attached to a wall structure 2. The rail is provided with means 3 for attachment to the wall structure 2. The upper portion of the rail 1 has an undercut with which the wall structure 1 forms an acute angle 5. This structure thus forms a suspending surface which is referred to within this disclosure as a suspending cleat 7. From this suspending cleat 7, a variety of structures may be vertically positioned without the need for other penetration of the wall structure 2. As illustrated in FIG. 1, a vertical panel 9 is illustrated which may form the part of a cabinet or other structure to be further described herein which, for purposes of description, is referred to as a suspended structure. The suspended structure forms by virtue of a mating undercut suspending cleat 11 which forms a complementary obtuse angle with the acute angle of the wall structure 2.

Figure 2:
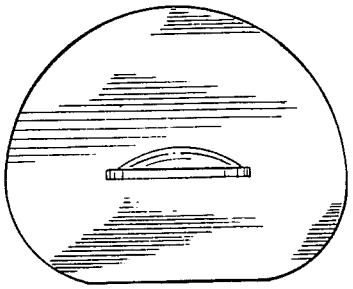
FIG. 2 of the drawings is a cross-section view of a plastic insert used in accordance with this invention.

It is preferred to utilize with suspended structures a plastic insert or saddle 13 which forms the suspended cleat and which may be easily attached to a recess 15 in a panel structure. This is best illustrated in FIG. 2 wherein the plastic insert 13 is illustrated as having a slot 19 to ease the installation of the saddle 13 into the suspended structure.

Figure 3:
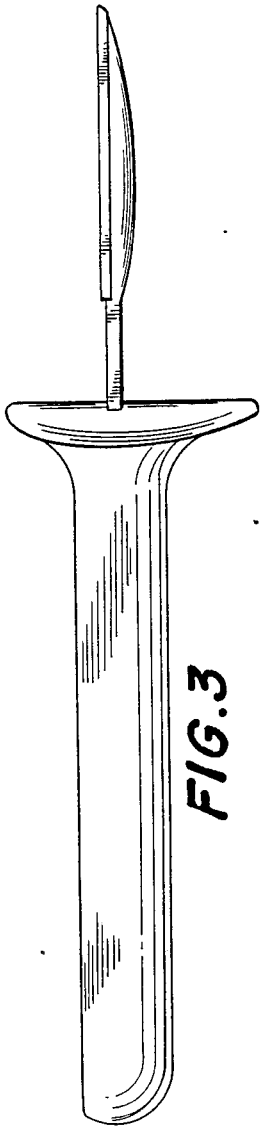
FIG. 3 of the drawings is a perspective view of a variety of wall mounted structures in accordance with this invention.

FIG. 3 of the drawings illustrates a variety of systems which may be suspended from horizontal rail 1 by cleat 7. As illustrated in FIG. 2, a cabinet structure 21 may be on one end of rail 1 while a shelving structure 23 supported from vertical rails 25 suspended from the horizontal rail 1 by a mechanism to be further described below.

Figure 4:
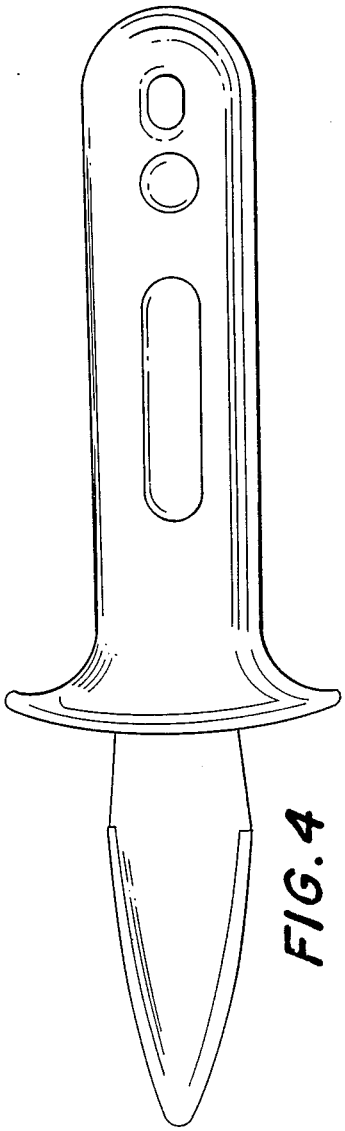
FIG. 4 of the drawings is a closeup perspective view of a cabinet in with this invention.
Figure 1:
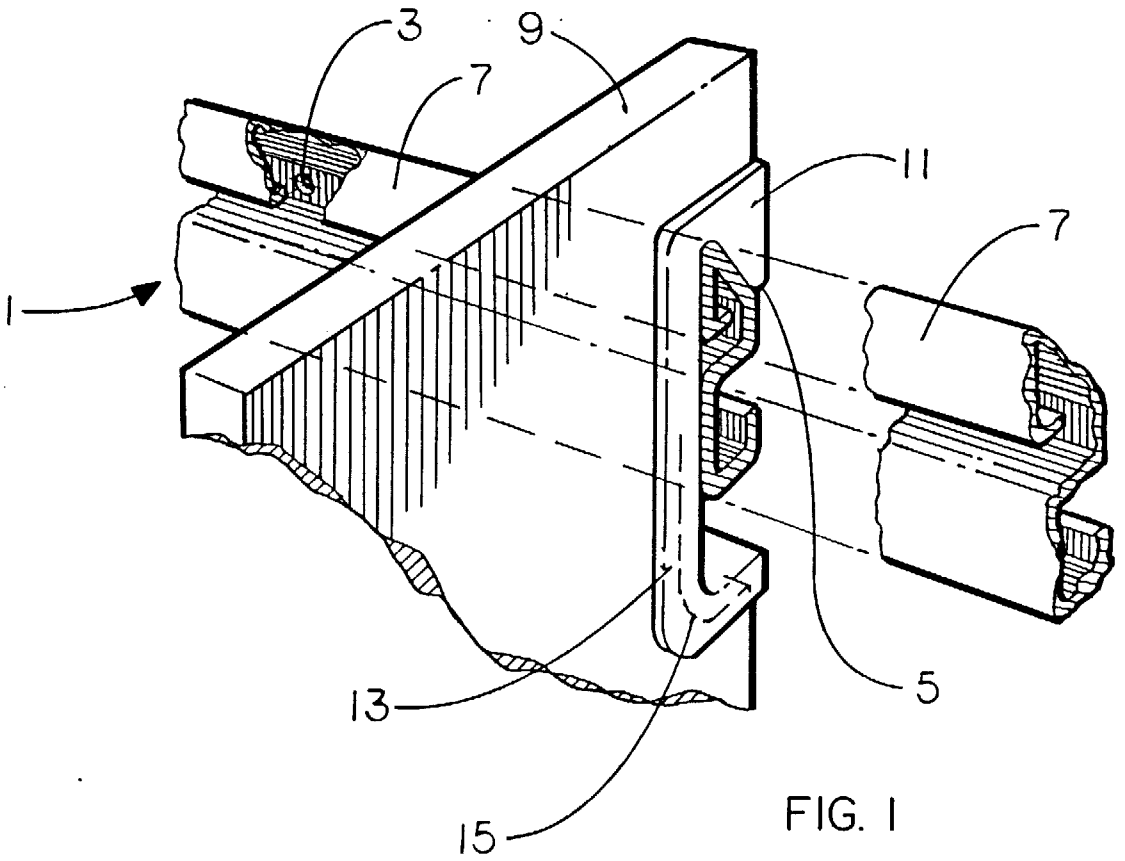
Figure 2:
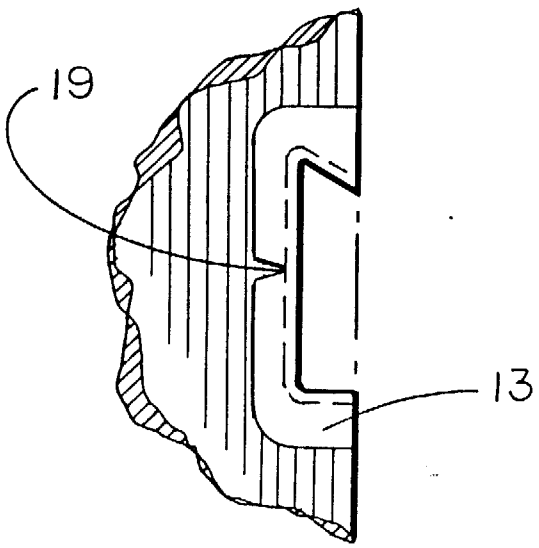
Figure 4:
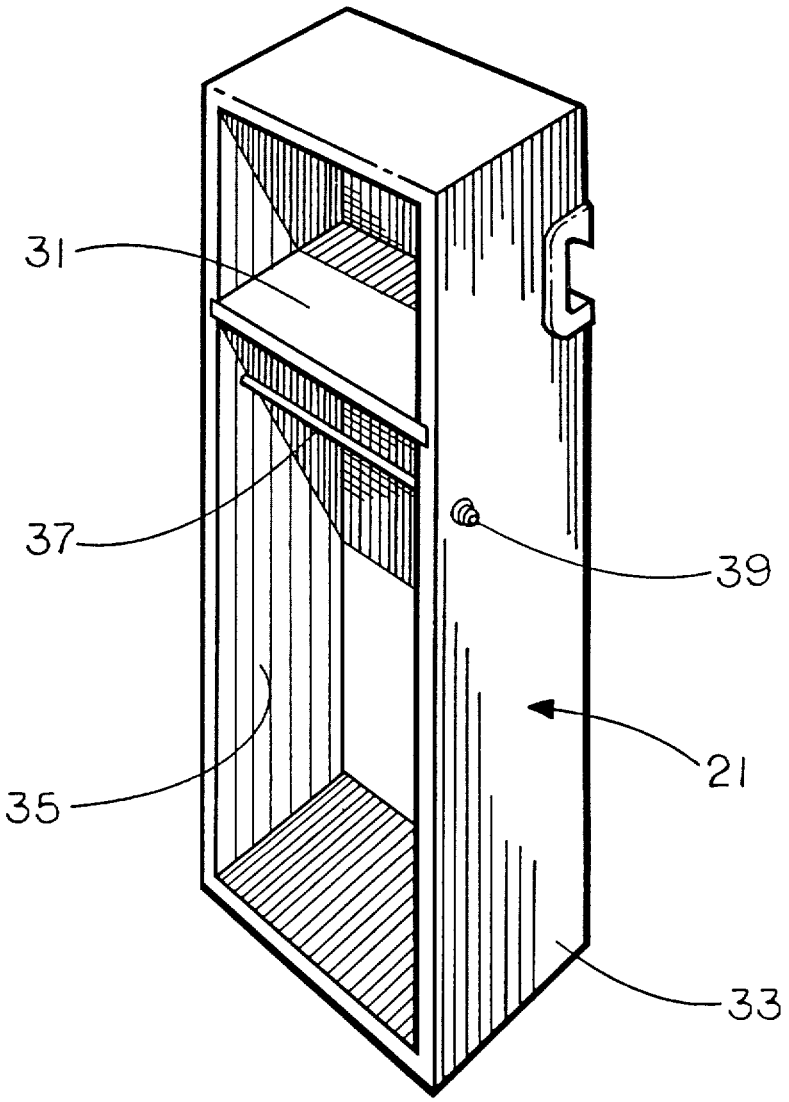
Figure 3:
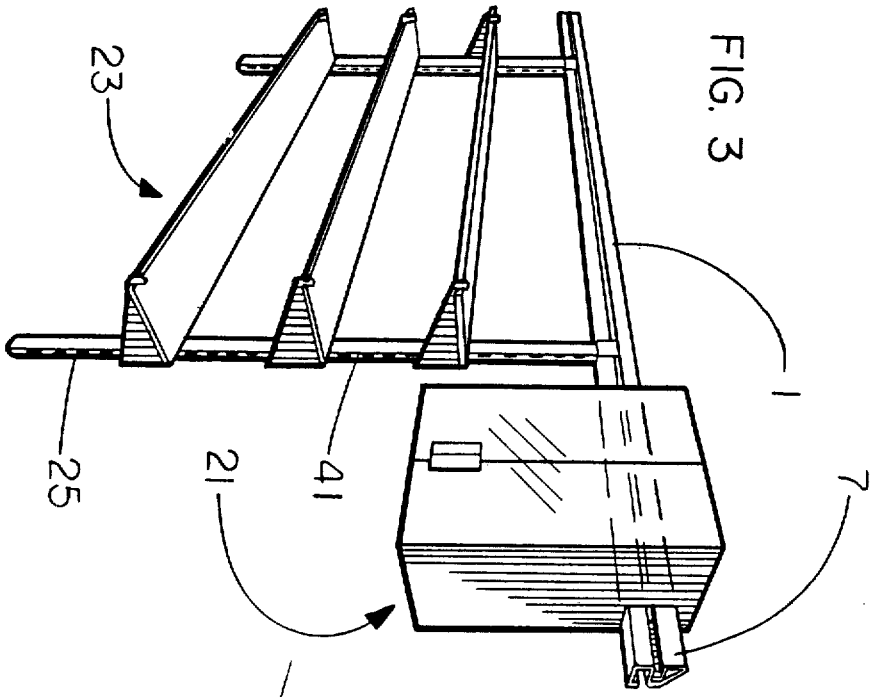
Figure 5:
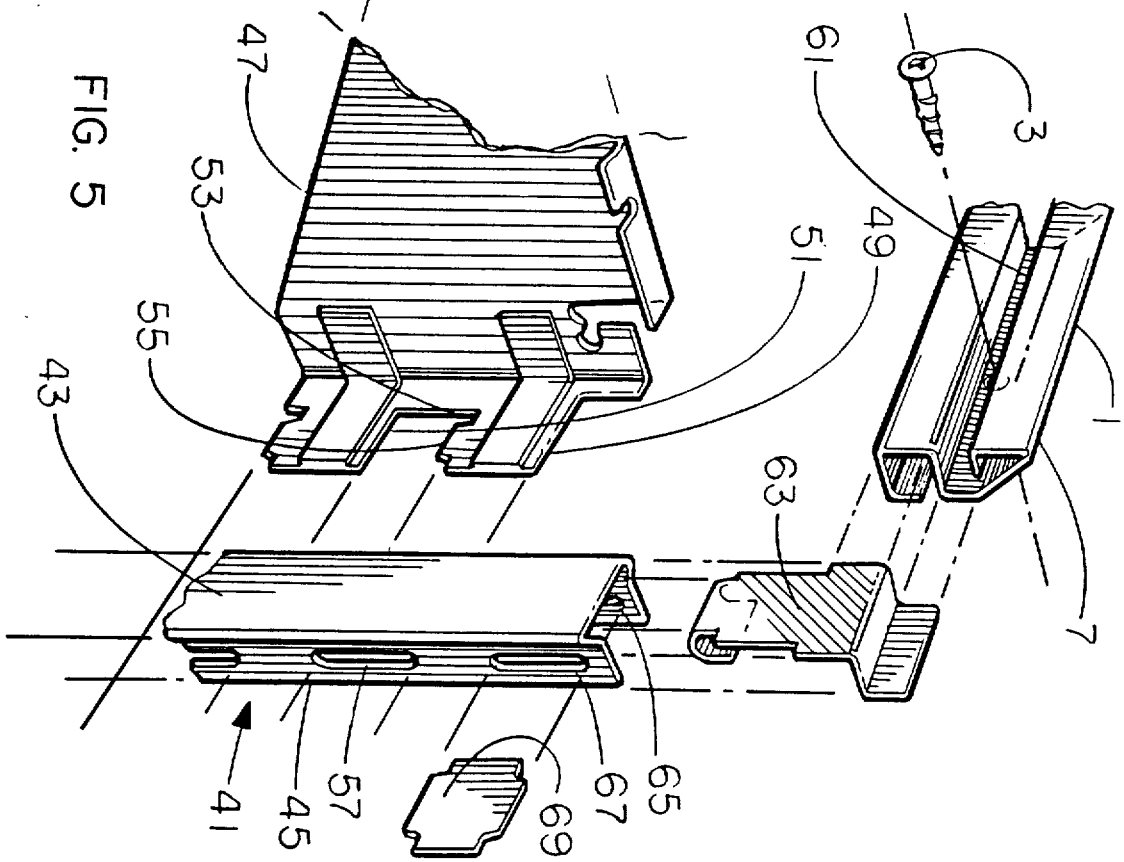
Figure 6:
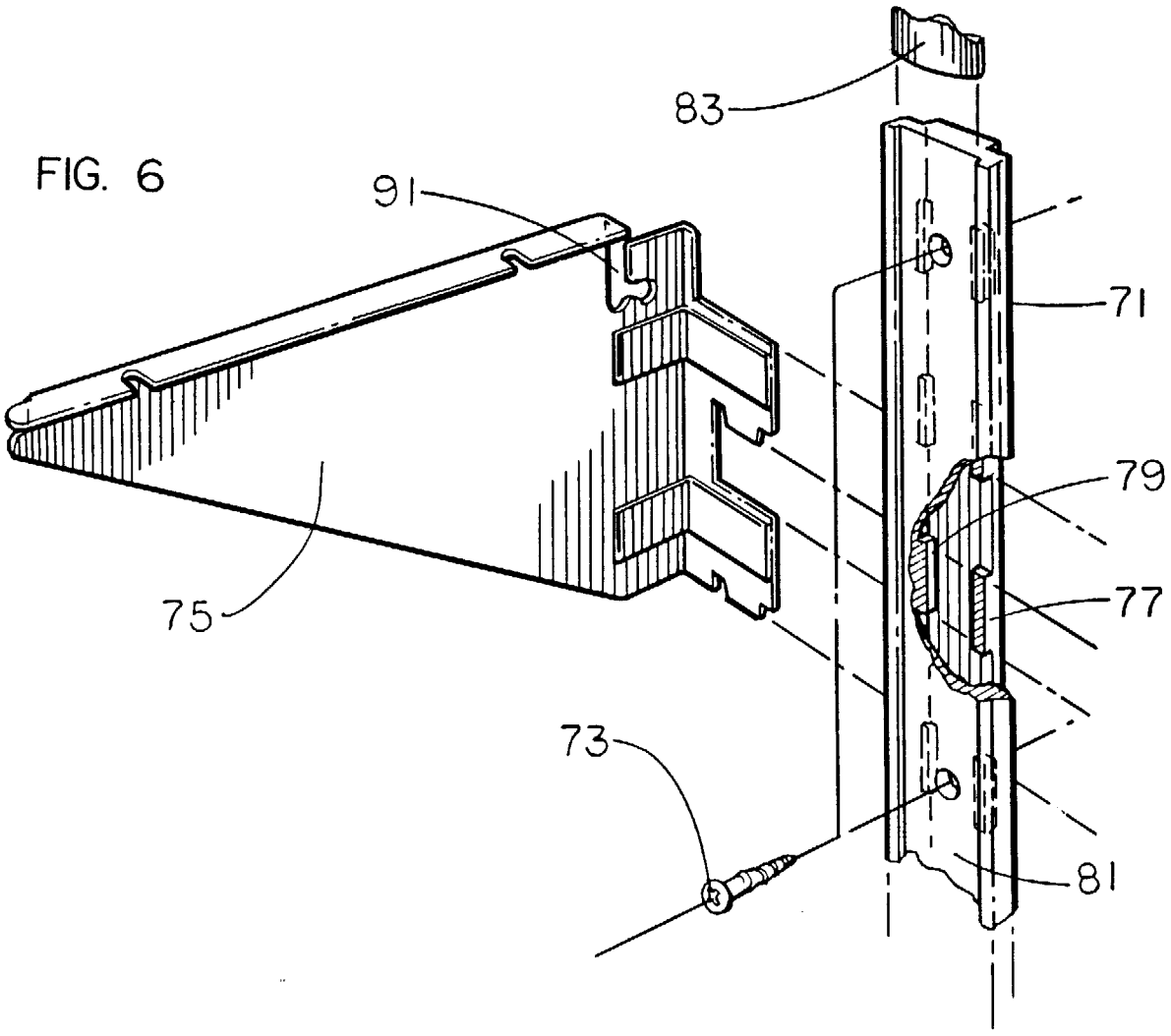

FIG. 4 of the drawings further illustrates the panel structure 21 and a shelf section 31 therein. It is preferred to attach the vertical panels 33 and 35 by means of a metal rod which runs between panels 33 and 35 and compresses such panels thus supporting shelf 31 above the metal rod. A plurality of metal rods may be utilized to support a plurality of shelving units. The metal rod 37 may be in the form of a threaded rod which is pressed into position by a nut 39. The metal rod, however, may be simply an unthreaded rod which utilizes a push nut as at 39 to maintain compression between the numbers 33 and 35 and thus across the shelving unit 31.

The shelving unit 23 will now be described in further detail. Shelving unit 23 has a pair of vertical rails 41 which are attached to horizontal rail 1 by means to be further described. Each vertical rail has a front portion 43 and a back portion 45 for the support of a shelf bracket 47. Each shelf bracket has hook-shaped projections 49 and 51 projecting therefrom. Each hook-shaped projection has a pair of vertical slots 53 and 55 which mate through gaps 57 between the front portion and rear portion of said vertical rails. The dual slots 53 and 55 provide a double area of support. It is seen that with this construction the viewed portion from the frontal view of the vertical rails 41 shows no indication of the support gaps of 57. The frontal portion 43 may be appropriately decorated or provided with inserts to be further described.

It is seen that the vertical rail 41 is suspended from the rail 1. In the embodiment illustrated in FIG. 5, the rail 1 is in the form of a generally inverted "S" which provides not only the suspending saddle 7, but a locking area 61 defined therein. The locking area 61 accepts a locking element 63 which may be horizontally moved the full extent of rail 1 to provide for precise location at any desired point. The locking element 63 is insertable between the front portion 43 and back portion 45 of vertical rail 41 to be located between and aligned with gaps 65 and 67 which receive a locking key 69 which retains locking member 63 in position and thus supports the vertical member 41 and its associated brackets and shelving units therefrom.

Figure 6:
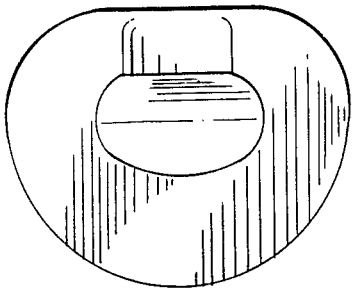
FIGS. 6 and 7 of the drawings are views similar to FIG. 5 showing different embodiments of shelving in accordance with this invention.
Figure 5:
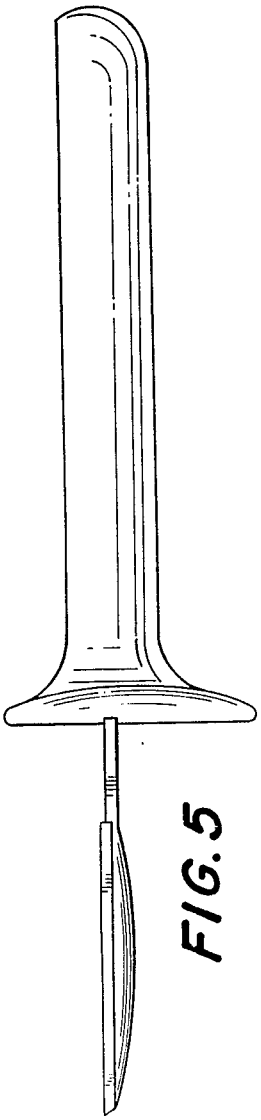
FIG. 5 of the drawings is a closeup perspective view of mounting shelving brackets in accordance with this invention.

A variation is illustrated in FIG. 6 wherein vertical members 71 are attached directly to a wall structure by mean 73 not associated with the horizontal rail of this invention. As illustrated therein, the mounting bracket 75 is attached to the vertical rail 71 in the same manner previously described by gaps such as 77 and 79. In this embodiment the front portion 81 of vertical rail 71 defines a slot which may receive a decorative strip 83 therethrough to be placed between shelves and otherwise obscure the attachment means 73 from view. The embodiment as illustrated in both FIGS. 5 and 6 illustrates slots 91 which may be used to suspend wire shelving systems as opposed to solid shelving systems. Thus in each embodiment there is the flexibility of suspending shelving and/or wire shelving which has become conventional in pantry structures.

Figure 7:
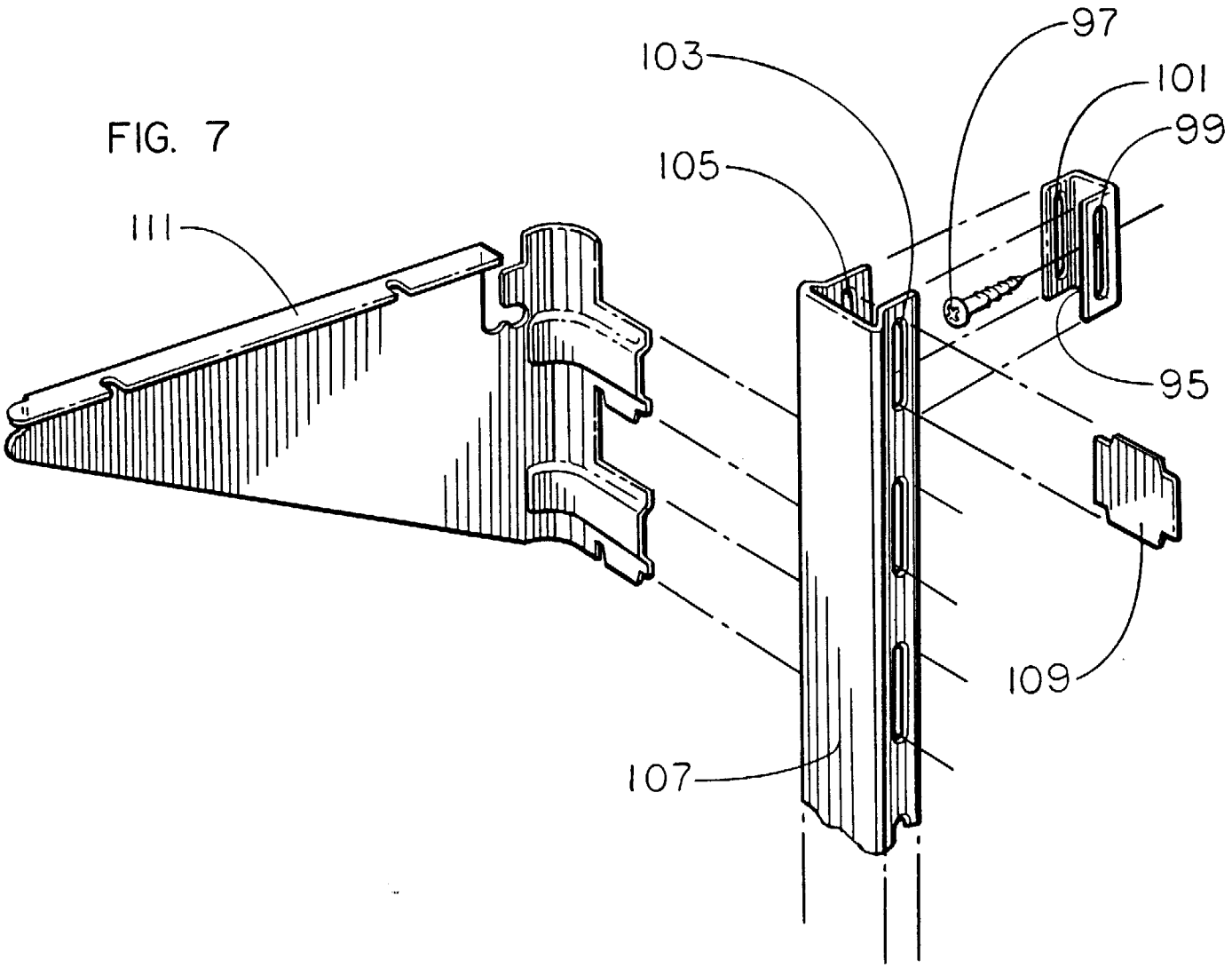

A further embodiment is illustrated in FIG. 7 wherein a locking mechanism 95 is attached to a wall structure by means 97. The locking mechanism 95 has adjoining vertical slots 99 and 101 which may align with vertical slots 103 and 105 of vertical rail 107. Upon alignment of the varied vertical slots, a locking key 109 locks the vertical rail to the wall structure. Bracket 111 may best be suspended from the vertical rail 107 in the manner previously described.

Figure 8:
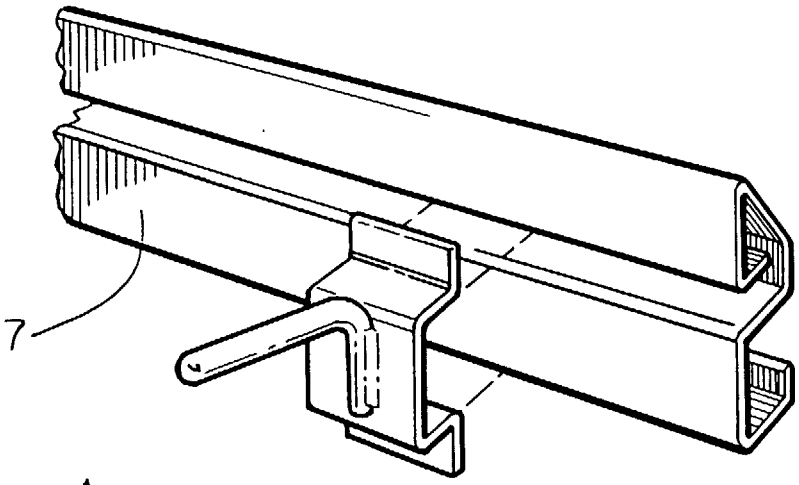
FIG. 8 of the drawings is a perspective view of a utility post matted in the horizontal rail in accordance with this invention.
Figure 9:
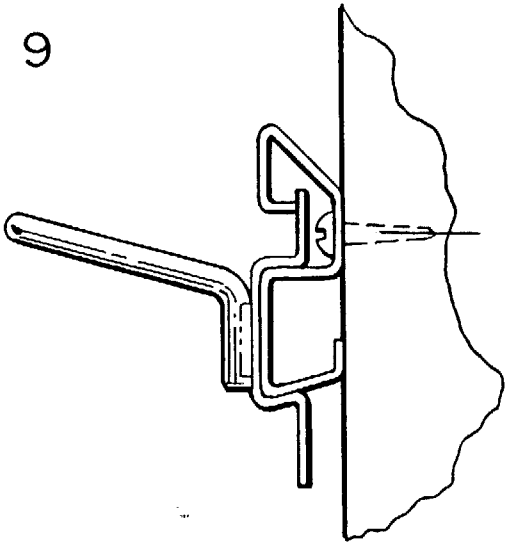
FIG. 9 of the drawings is a right-hand view of FIG. 8 in accordance with this invention.

A further embodiment utilizing the rail 7 of this invention is illustrated in FIGS. 8 and 9 wherein a utility post 121 is locked in place by a bracket 123 which intermeshes with horizontal rail 7 as best illustrated in the inverted "S" configuration of FIG. 9.

Figure 10:
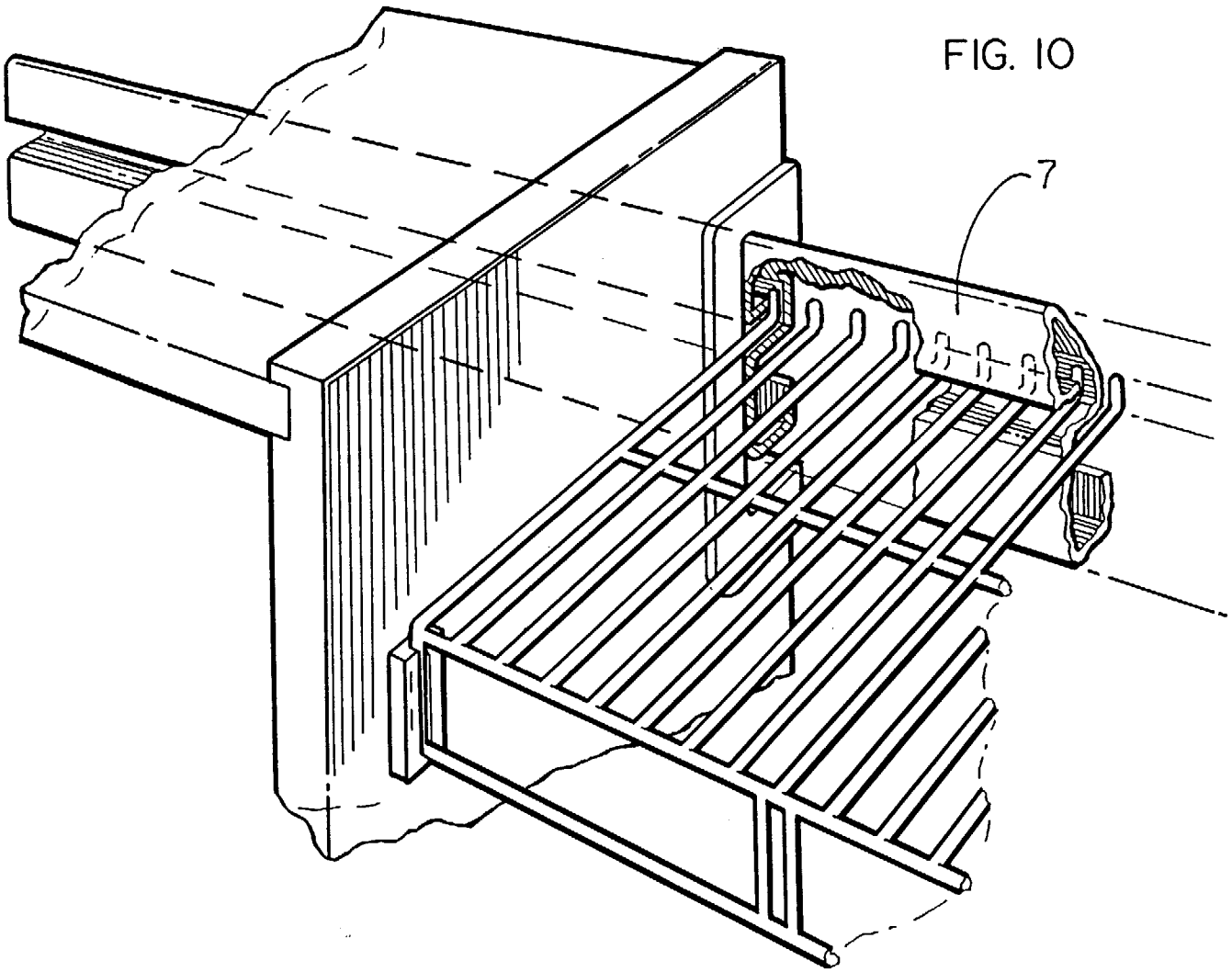
FIG. 10 of the drawings is a perspective view of another use of a wall matted rail in accordance with this invention.

A further embodiment utilizing the inverted "S" shape of rail 7 is illustrated in FIG. 10. In this illustration a wire shelving unit 131 interlocks as illustrated and utilizes a further mounting bracket 135 which may be mounted upon the side of a shelving unit such as 21 illustrated in FIG. 4.

It is this seen that the wall mounting system of this invention provides a novel wall mounting system which minimizes wall damage while permitting great flexibility in the arrangement of suspended structures from the wall. As many variations and modifications will become apparent to those of skill in the art from a reading of the foregoing description, which is exemplary in nature, such variations and modifications are within the scope and spirit of this invention as defined by the following appended claims.

That which is claimed is:

1. A wall mounting system comprising:

a horizontally mounted rail attached to a wall structure said rail having a top surface which is undercut to form an acute angle at the juncture with said wall structure, said undercut forming on the top surface with juncture of said wall structure a suspending cleat, said horizontally mounted rail including a first horizontal flange with a first vertical flange extending upwardly from one end thereof, a flange extending downwardly at an acute angle from the top end of the first vertical flange in the direction of the other end of the first horizontal flange and spaced therefrom, a second horizontal flange extending at one end from the bottom end of the angled flange toward the one end of the first horizontal flange and spaced therebelow, and a second vertical flange extending downwardly from the other end of the second horizontal flange and being coplanar with the first vertical flange, with the cleat being formed by the angled flange and a locking area located between the first and second horizontal flanges. said suspending cleat to support said suspended structure from said rail.

2. The wall mounting system in accordance with claim 1 further comprising an insert within said suspended structure which mates with said suspended structure and forms said obtuse angle and thus forms a suspended cleat to mate with said suspending cleat.

3. The wall mounting system according to claim 1 wherein said suspended structure is a cabinet.

4. The wall mounting system according to claim 1 further including a vertical rail suspended from said locking area.

5. The wall mounting system in accordance with claim 4 wherein said vertical rail has a front portion and a back portion, and further including;

a shelf bracket extending perpendicularly outwardly from said vertical rail and including a flange;

hook-shaped projection extending from said flange, said hook-shaped projections each having dual vertical slots;

spaced members defining gaps therebetween connecting said front portion of said vertical rail to said back portion of said vertical rail; and said hook-shaped projections projecting through said gaps defined between said spaced members thereby removably supportably attaching said shelf bracket to said vertical rail by interlocking with said two vertical slots.

6. The wall mounting system in accordance with claim 5 further including a longitudinal slot defined in said front portion and a decorative insert received in said slot covering the remainder of said front portion.

7. The wall mounting support system according to claim 1 wherein said suspended structure is a cabinet, said cabinet comprising oppositely spaced vertical panels each said vertical panel defining a suspended cleat to interconnect with said suspending cleat;

said vertical panels having therebetween a horizontal shelf with said horizontal shelf supported by a metal rod connecting said vertical panels and compressing said panels together.

8. The wall mounting system in accordance with claim 7 wherein said metal rod is a threaded rod and is bolted to said vertical panels.

9. The wall mounting system in accordance with claim 7 wherein said metal rod has pushed nuts on either end thereof to compress said vertical panels toward one another.

10. The wall mounting system in accordance with claim 7 comprising a multiplicity of said metal rods beneath each said shelf.

* * * * *

UNITED STATES PATENT AND TRADEMARK OFFICE

CERTIFICATE OF CORRECTION

PATENT NO. : 4,928,913

DATED : May 29, 1990

INVENTOR(S) : Laughon, et al

It is certified that error appears in the above-identified patent and that said Letters Patent is hereby corrected as shown below:

Title page showing the illustrative figures should be deleted to appear as per attached title page.

Figures 1 through 6 of the issued patent should be replaced with Figures 1 through 10 attached hereto.

Signed and Sealed this

Twentieth Day of November, 1990

*Attest:*

*Attesting Officer*

HARRY F. MANBECK, JR.

*Commissioner of Patents and Trademarks*

United States Patent [19]

Laughon et al.

[11] Patent Number: 4,928,913

[45] Date of Patent: May 29, 1990

[54] WALL MOUNTING SYSTEM

[75] Inventors: Thomas C. Laughon; Roy V. Nicholson; Michael E. Barrett, all of Hickory; Robert C. Beckmann, Vale, all of N.C.

[73] Assignee: McCalla/Lackey Products Corporation, Hickory, N.C.

[21] Appl. No.: 321,378

[22] Filed: Mar. 10, 1989

[51] Int. Cl.[5] ..... A47B 67/02

[52] U.S. Cl. ..... 248/224.1; 248/243; 248/214; 312/245; 211/90; 211/94

[58] Field of Search ..... 248/544, 220.2, 223.4, 248/235, 300, 220.3, 224.1, 224.2, 224.4, 241, 243, 247, 248, 214; 108/108, 102, 143, 137; 211/162, 94, 90, 87; 312/245

[56] References Cited

U.S. PATENT DOCUMENTS

| | | | |
|---|---|---|---|
| 178,534 | 6/1876 | Latham | 248/224.2 |
| 1,880,179 | 9/1932 | Onions | 248/243 |
| 2,191,701 | 2/1940 | Wood | 248/243 |
| 2,521,134 | 9/1950 | Stanitz | 312/245 |
| 3,311,435 | 3/1967 | Heritage | 248/224.2 |
| 3,337,172 | 8/1967 | Jackson | 312/245 |
| 3,899,228 | 8/1975 | Schreiber | 312/245 |
| 3,950,049 | 4/1976 | Drass | 312/245 |
| 3,993,002 | 11/1976 | Stroh | 211/90 |
| 4,342,439 | 8/1982 | Bruner | 248/544 |
| 4,467,925 | 8/1984 | Ratzloff | 248/214 |
| 4,596,195 | 6/1986 | Wenger | 211/94 |
| 4,793,267 | 12/1988 | Birillo | 108/108 |

FOREIGN PATENT DOCUMENTS

| | | | |
|---|---|---|---|
| 2276019 | 1/1976 | France | 248/224.1 |
| 2490940 | 4/1982 | France | 312/245 |
| 1198887 | 7/1970 | United Kingdom | 248/243 |

*Primary Examiner*—Blair M. Johnson
*Assistant Examiner*—Robert A. Olson
*Attorney, Agent, or Firm*—Bailey & Hardaway

[57] ABSTRACT

A wall mounting system wherein a single horizontal rail is attached to a wall structure and suspended components are supported by an undercut forming a cleat on the top of the rail. The supported structures may be cabinets, vertical rails supporting shelving brackets mounted so as to eliminate the view of the mounting system from a frontal observation, a novel insert is provided to aid in suspending members from the horizontal rail.

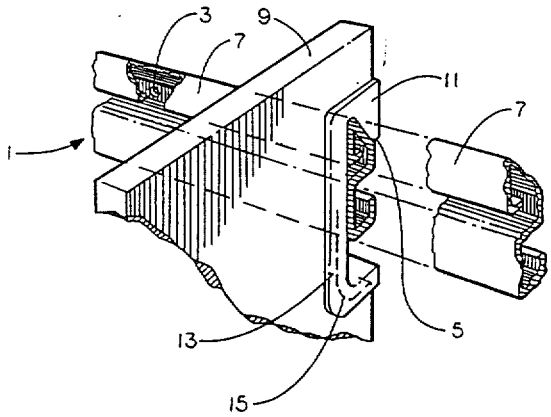

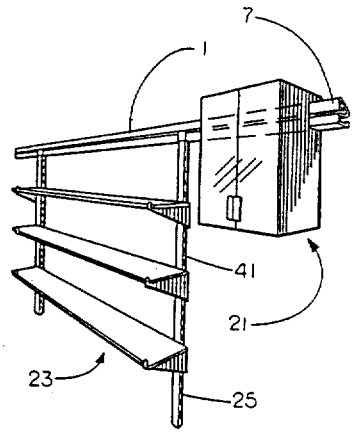

10 Claims, 7 Drawing Sheets